US010434035B2

(12) United States Patent
Pineda et al.

(10) Patent No.: US 10,434,035 B2
(45) Date of Patent: Oct. 8, 2019

(54) AUTOMATIC PACING SYSTEM FOR A BABY BOTTLE

(71) Applicant: Preemie-Pacer, LLC, O'Fallon, MO (US)

(72) Inventors: Roberta Pineda, St. Louis, MO (US); Jeffrey Macler, Tecumseh, MO (US)

(73) Assignee: Preemie-Pacer, LLC, O'Fallon, MO (US)

( * ) Notice: Subject to any disclaimer, the term of this patent is extended or adjusted under 35 U.S.C. 154(b) by 874 days.

(21) Appl. No.: 14/709,237

(22) Filed: May 11, 2015

(65) Prior Publication Data

US 2015/0335533 A1 Nov. 26, 2015

Related U.S. Application Data

(63) Continuation-in-part of application No. 14/205,574, filed on Mar. 12, 2014, now Pat. No. 9,033,167.

(60) Provisional application No. 61/777,312, filed on Mar. 12, 2013.

(51) Int. Cl.

| | |
|---|---|
| ***A61J 9/00*** | (2006.01) |
| ***A61J 11/00*** | (2006.01) |
| ***A61J 15/00*** | (2006.01) |

(52) U.S. Cl.

CPC ..... *A61J 9/00* (2013.01); *A61J 11/002* (2013.01); *A61J 15/0076* (2015.05); *A61J 9/001* (2013.01); *Y10T 137/7924* (2015.04)

(58) Field of Classification Search

CPC ..... A61J 9/00; A61J 15/0076; A61J 9/04
USPC ..... 215/11.4, 11.1–11.3
See application file for complete search history.

(56) References Cited

U.S. PATENT DOCUMENTS

| | | | | | |
|---|---|---|---|---|---|
| 2,793,778 | A | * | 5/1957 | Keaton | A61J 9/001 215/11.1 |
| 4,339,046 | A | | 7/1982 | Coen | |
| 4,813,933 | A | * | 3/1989 | Turner | A61J 15/0011 604/79 |
| 5,057,077 | A | * | 10/1991 | Turner | A61J 15/0053 604/247 |
| 5,150,800 | A | | 9/1992 | Sarter et al. | |

(Continued)

FOREIGN PATENT DOCUMENTS

| | | | | |
|---|---|---|---|---|
| GB | 2202449 | * | 3/1997 | A61J 9/00 |
| WO | 2012174315 A1 | | 12/2012 | |

*Primary Examiner* — Anthony D Stashick
*Assistant Examiner* — Raven Collins
(74) *Attorney, Agent, or Firm* — Lewis Rice LLC

(57) ABSTRACT

A baby bottle, an insert for a baby bottle, a baby bottle including an insert, and a method of feeding an infant that serves to pace the infant's feeding rhythm. Generally, these devices and methods will be of use for a preterm infant who lacks coordination of the suck-swallow-breathe synchrony, but can also be used with full term infants who can benefit from rigid control of the flow of milk from a bottle, this includes, but is not limited to, infants with gastroesophageal reflux who can require pacing of feeds to allow for gastric emptying. The device generally cues the infant to swallow and breathe after each 1-4 sucks by stopping the flow of the fluid from the bottle after the infant has sucked sufficiently or a predetermined period of time has passed. Once the baby breathes or a period of time passes, the bottle resets for the next repetition. The device also serves to consistently slow the flow of milk during oral feeding.

11 Claims, 10 Drawing Sheets

(56) References Cited

U.S. PATENT DOCUMENTS

| | | | | |
|---|---|---|---|---|
| 5,269,425 | A * | 12/1993 | Gomez-Acevedo | A61J 9/00 215/11.1 |
| 5,791,503 | A | 8/1998 | Lyons | |
| 6,033,367 | A | 3/2000 | Goldfield | |
| 6,574,985 | B2 * | 6/2003 | Fiore, Jr. | A45F 3/18 62/457.4 |
| 6,659,302 | B2 | 12/2003 | Lin | |
| 6,966,904 | B2 | 11/2005 | Ruth et al. | |
| 7,320,678 | B2 | 1/2008 | Ruth et al. | |
| 8,413,502 | B2 | 4/2013 | Zemel et al. | |
| 8,473,219 | B2 | 6/2013 | Kaplan et al. | |
| D716,461 | S | 10/2014 | Lau et al. | |
| 8,979,896 | B2 | 3/2015 | Barlow et al. | |
| 2001/0002011 | A1 | 5/2001 | Tebeau | |
| 2007/0235405 | A1 * | 10/2007 | Al-Thallab | A61J 9/00 215/11.1 |
| 2011/0000867 | A1 | 1/2011 | Lau et al. | |
| 2011/0151069 | A1 * | 6/2011 | Harding | A61J 9/001 426/117 |
| 2011/0266245 | A1 | 11/2011 | Lau | |
| 2013/0153527 | A1 | 6/2013 | Lau et al. | |
| 2015/0001171 | A1 | 1/2015 | Lau | |
| 2015/0196247 | A1 | 7/2015 | Lau | |
| 2015/0208979 | A1 | 7/2015 | Cunningham et al. | |

* cited by examiner

AUTOMATIC PACING SYSTEM FOR A BABY BOTTLE

CROSS REFERENCE TO RELATED APPLICATION(S)

This application is a Continuation-in-Part (CIP) of U.S. Utility patent application Ser. No. 14/205,574 filed Mar. 12, 2014 and now U.S. Pat. No. 9,033,167 which, in turn, claims benefit of U.S. Provisional Patent Application No. 61/777,312, filed Mar. 12, 2013. The entire disclosure of all the above documents is herein incorporated by reference.

BACKGROUND

1. Field of the Invention

This disclosure is related to the field of devices and methods for providing intermittent flow in a vessel, particularly intermittent flow in a baby bottle to assist in teaching preterm infants to successfully eat.

2. Description of the Related Art

The average gestation period of a human being is generally considered to be 280 days, or around 40 weeks. Recent science has indicated that birth, without any medical intervention or complications of preterm birth, will, on average, occur at a little over 38 weeks after fertilization. Generally, an infant born from 37-42 weeks after conception is considered to be "full term." A large number of babies, however, are born prior to this period. In the United States around 12% of babies born each year are considered to be "preterm," that is, before the $37^{th}$ week. Some of these births occur spontaneously, some occur due to complications in pregnancy, others are scheduled early due to the need for planned Cesarean section births, some are due induced labor following abnormal lab results, and others from concern that an infant is getting too large to be easily delivered.

Regardless of the reason that an infant is born preterm, preterm infants (and even those born in the $38^{th}$ and $39^{th}$ week compared to those born later) generally have more medical issues at birth than full term infants. For example, infant mortality rates for preterm infants are generally double those of full term infants. Another problem associated with preterm babies is that they have trouble learning how to eat. The act of nursing (or alternatively eating from a bottle) generally requires an infant to follow a pattern usually referred to as "suck-swallow-breathe." In this pattern, an infant sucks once, swallows once, breathes once, and then repeats. Preterm infants, however, may feed with repetitions of 3 or 4 (or more) sucks and swallows and 1 breathing break. However, many preterm infants have trouble maintaining any pattern and an inability to feed can lead to further complications with the infant; this can result in increased medical expense because of the need to keep them at a hospital.

Because many preterm infants (and particularly very early preterm infants) are maintained in a Neonatal Intensive Care Unit (NICU), they are often bottle fed (breastfeeding is a challenge) and effective feeding patterns must be imposed until the central nervous system matures to enable coordination of the suck-swallow-breathe pattern. While preterm infants often demonstrate adequate suction and compression on the bottle to express milk very early in gestation, the immature central nervous system does not signal the infant to pause for respiration, which results in inadequate oxygen in the blood and dangerous drops in heart rate. In the months prior to term equivalent age, cautious caregivers can promote an imposed breathing break by allowing the infant to take a few sucks from the bottle followed by pulling the bottle out of the infant's mouth. This procedure requires special expertise and considerable time, causes the infant significant energy expenditure and physiological stress, and disrupts the feeding process. The complexities of feeding infants delay discharge and increase hospital costs. NICU nurses and therapists currently manually pace preterm infants during bottle feeding, and parents are often taught how to pace preterm infants during oral feeds. It has been found that many preterm infants will continue sucking until prompted to swallow and breathe by the feeder. During feeding, monitors attached to the infants in the NICU collect data regarding respiration, heart rate and other vital signs to assist the nurse in knowing when to prompt the infant to swallow and breathe. However, these monitors often take longer to alert a nurse than desired. This requires the nurse to analyze the infant's facial features for signs of stress, such as raised eyebrows, breathing difficulty, or blue discoloration.

When the NICU nurse detects that the infant needs to breathe, the nurse tilts or, if necessary, completely removes the bottle to stop the flow of liquid from the bottle. This cues the infant to swallow and begin breathing again. This system is highly subjective to human intervention and requires constant attention during feeding to minimize the possibility of risks such as choking or aspiration. Many infants will eventually pick up the rhythm of suck-swallow-breathe after only a few repetitions, and it is desirable for infants that quickly pick up the pattern to begin pacing naturally as that allows them to maintain their own pattern and maintain their own pace while maximizing the amount of intake. Removing or maneuvering the bottle can often cause problems with the infant establishing a pattern, gaining an adequate swallow on fluid that has been expressed, and/or re-establishing the feeding response. Therefore it is desirable to provide a more simplified solution for establishing an eating pattern.

SUMMARY

The following is a summary of the invention which should provide to the reader a basic understanding of some aspects of the invention. This summary is not intended to identify critical components of the invention, nor in any way to delineate the scope of the invention. The sole purpose of this summary is to present in simplified language some aspects of the invention as a prelude to the more detailed description presented below.

Because of these and other problems in the art, it is desirable to provide a feeding device that eliminates the need to constantly monitor a feeding in a preterm infant and manually alter the flow of liquid in a bottle.

There is described herein, among other things, a baby bottle for providing paced feeding, the bottle comprising: a storage chamber, containing a first amount of fluid; a feeding reservoir, containing a second amount of the fluid smaller than the first amount, the feeding reservoir in fluid communication with the storage chamber; a nipple in fluid communication with the feeding reservoir; and a pump for moving fluid from storage chamber to the feeding reservoir; wherein when an infant sucks on the nipple, they can only obtain the second amount of the fluid at predetermined periods of time or until they cease sucking at which point the pump will feed the second amount of fluid from the storage chamber to the feeding reservoir.

In an embodiment of the bottle, when the infant ceases sucking, the infant breathes and the infant's breath is detected by an electronic sensor.

In an embodiment of the bottle, the electronic sensor instructs a computer to activate the pump upon the breath being detected.

In an embodiment of the bottle, when the infant ceases sucking, a change in pressure is detected by an electronic sensor.

In an embodiment of the bottle, the electronic sensor instructs a computer to activate the pump upon the change being detected.

In an embodiment of the bottle, the pump is a peristaltic pump.

In an embodiment of the bottle, the feeding reservoir and the storage chamber are connected by a tube.

In an embodiment of the bottle, the feeding reservoir, storage chamber, and tube are removable from the bottle as a unit.

In an embodiment of the bottle, the storage chamber is a rigid bottle.

In an embodiment of the bottle, the storage chamber is a flexible bag.

In an embodiment of the bottle, the storage chamber, feeding reservoir, and pump are housed in a single structure.

In an embodiment of the bottle, the single structure comprises a body attached to the nipple.

In an embodiment of the bottle, the body opens in the form of a clamshell.

In an embodiment of the bottle, the feeding chamber comprises a portion of an interior volume of a tube connected to the storage chamber.

In an embodiment of the bottle, the feeding chamber consists of a portion of an interior volume of a tube connected to the storage chamber.

In an embodiment of the bottle, the infant fed by the bottle is a preterm infant or other infant with the need for slow, paced, or intermittent flow feedings.

There is also described herein a baby bottle for providing paced feeding, the bottle comprising: a storage chamber, containing a first amount of fluid; a tube in fluid communication with the storage chamber; a peristaltic pump connected to the tube to move fluid from the storage chamber to a portion of the tube forward of the pump, the portion of the tube forward of the pump comprising a feeding reservoir internal thereto; a nipple comprising a teat having a hole, the feeding reservoir being in direct fluid contact with the hole.

DESCRIPTION OF THE PREFERRED EMBODIMENT(S)

Figure 1A:
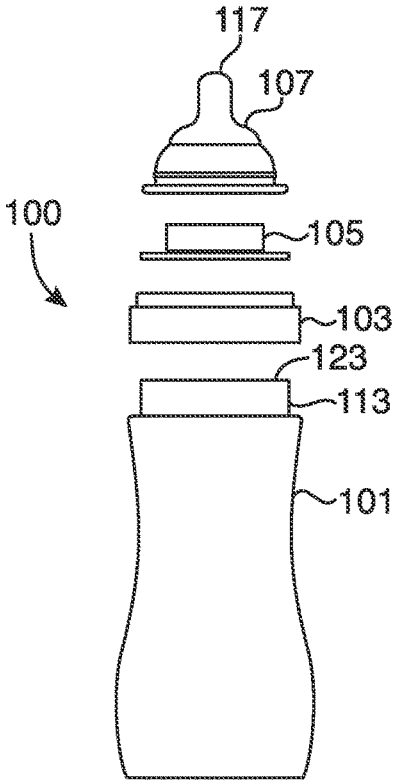
FIGS. 1A, 1B, and 1C provide an exploded view, assembly side view, and perspective view, respectively, of an embodiment of a baby bottle including a pacing valve.

The following detailed description and disclosure illustrates by way of example and not by way of limitation. This description will clearly enable one skilled in the art to make and use the disclosed systems and apparatus, and describes several embodiments, adaptations, variations, alternatives and uses of the disclosed systems and apparatus. As various changes could be made in the above constructions without departing from the scope of the disclosures, it is intended that all matter contained in the above description or shown in the accompanying drawings shall be interpreted as illustrative and not in a limiting sense.

A normal NICU feeding bottle contains about 30-90 milliliters of solution in a generally cylindrical bottle (100) as shown in FIG. 1. While there is some variation among baby bottles, those used in any particular NICU are generally of a particular type and most are broadly similar. It is preferable that the feeding control be provided without needing to fundamentally alter the baby bottle (100) or having to provide a specialized bottle as that requires NICU nurses to utilize a particular baby bottle for all infants, which can be undesirable. Further, while the device is primarily for use by medical personnel, parents can be present and may need to continue the same feeding pattern at home. Thus, a feeding device needs to be simple to use, replicate its function regardless of the user, be dependable to minimize a chance of failure or further frustration for the infant, and be usable and effective for a variety of ranges of strength and feeding styles of preterm infants.

Further, because of its use in both a hospital and home setting, while in an embodiment the device may be disposable and single use, the device can preferably be provided sterile, be re-sterilizable, and is ideally easily washable, preferably in a standard dishwasher.

FIG. 1 provides an embodiment of an insert in the form of a pacing valve (105) for use with an infant bottle (100) that serves to provide for intermittent flow. The bottle (100) is of standard design and comprises a main body (101), which is used to house milk, formula, or another liquid product for feeding the infant, a nipple (107) upon which the infant sucks in order to pull fluid from the main body, and a connecting ring (103) which serves to hold the nipple (107) in place on the bottle (100). In a traditional operation, the main body (101) is filled with fluid, the nipple (107) is seated inside the connecting ring (103), and the connecting ring is screwed onto a mating screw ring (113) on the main body. The bottle is then inverted (placing the nipple (107) below the main body (101)). Fluid flows from the main body (101) into the nipple and is held in place inside the nipple (107).

The nipple will generally include at least one hole at its distal end (117) through which the fluid can pass. For very young infants, the hole is usually sufficiently small that the surface tension of the fluid will not allow it to pass through without pressure being applied. An infant is fed by placing the nipple (107) in their mouth. They will generally instinctually suck on the nipple (107) pulling the fluid through the hole and into their mouth. For an infant that has suck-swallow-breathe activity, once the infant has sufficient fluid in their mouth, they will cease sucking on the nipple (107) and swallow. They will then breathe, which may relax the pressure generated in the nipple (107).

In the embodiment of FIG. 1, in order to assist with the suck-swallow-breathe activity, there is a pacing valve (105) placed in the connecting ring (103) under the nipple. As seen in FIG. 1, the pacing valve (105) is designed to seat behind and partially within the structure of the nipple and will generally be held in place by the connecting ring (103). Because of its position, fluid in the main body (101) has to pass through the pacing valve (105) in order to go from the main body to the nipple (107).

Figure 1B:
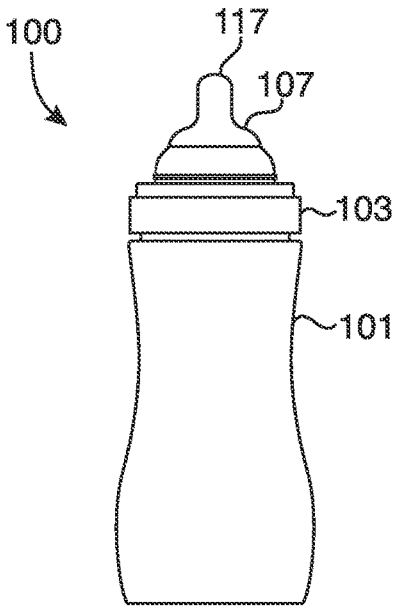
Figure 1C:
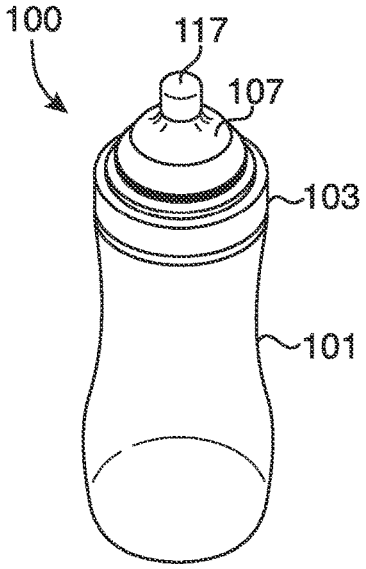
Figure 2A:
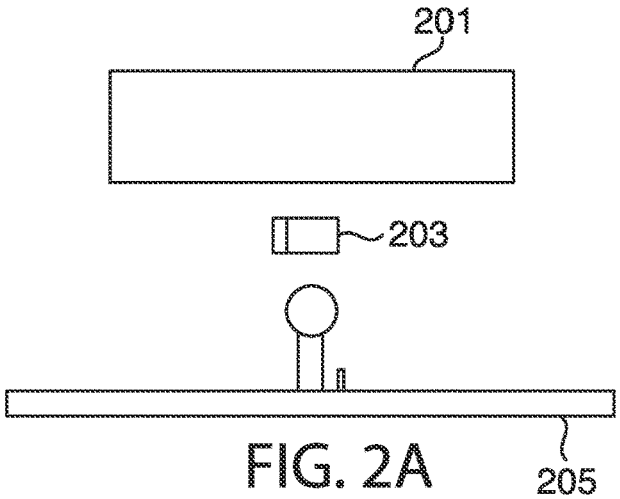
FIGS. 2A, 2B, and 2C provide an exploded view, assembly side view, and perspective view, respectively, of an embodiment of a pacing valve.
Figure 2B:
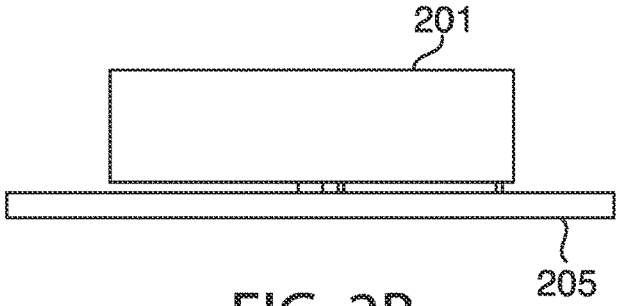
Figure 2C:
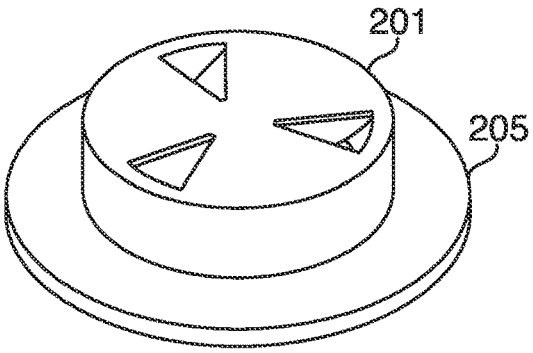
Figure 3:
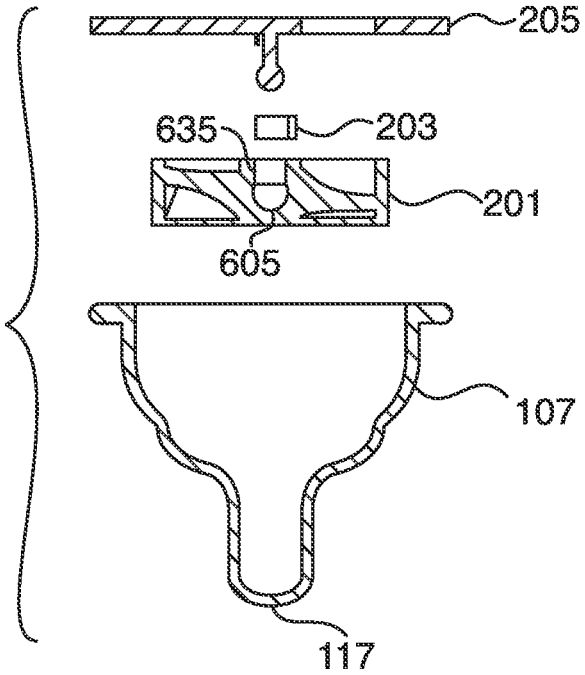
FIG. 3 provides a side sectional exploded view of the components of an embodiment of a pacing valve and bottle nipple.

The pacing valve (105) of FIGS. 1A-1C, and as shown in the embodiment of FIGS. 2A-2C, comprises three major components. A base (205), a spring (203) and a turbine (201). The spring (203) is shown in detail in FIGS. 5A-5C and comprises a rotary spring. The spring (203) attaches to the turbine (201), which is shown in greater detail in FIGS. 6A-6E, and the base (205), which is shown in greater detail in FIGS. 4A-4C. The turbine (201) and base (205) snap together around the spring (203) to complete the system. As can be seen in FIG. 1, the pacing valve (105) is designed to fit within the connecting ring (103) of a standard NICU, or any other, baby bottle (100). FIG. 3 provides some additional detail showing the pacing valve (105) in an exploded sectioned view seated behind a nipple (107).

In operation, the turbine (201) rotates through a controlled arc and includes openings (601) which are either aligned, or misaligned, with openings (401) in the base (205). When the two sets of openings (401) and (601) are aligned (open state), fluid can flow from the main body (101), through the base (205), through the turbine (201) and into the nipple (107). When the openings (401) and (601) are misaligned (closed state), fluid is restrained at the pacing valve (105) and cannot enter the nipple (107). The turbine (201) alternates between open and closed states with the base due to the fluid flow induced by the infant sucking on the nipple (107) and spring dynamics. The closed state stops flow to allow the infant to swallow and breathe. The open state allows fluid to flow into the nipple for the infant to feed.

Figure 4A:
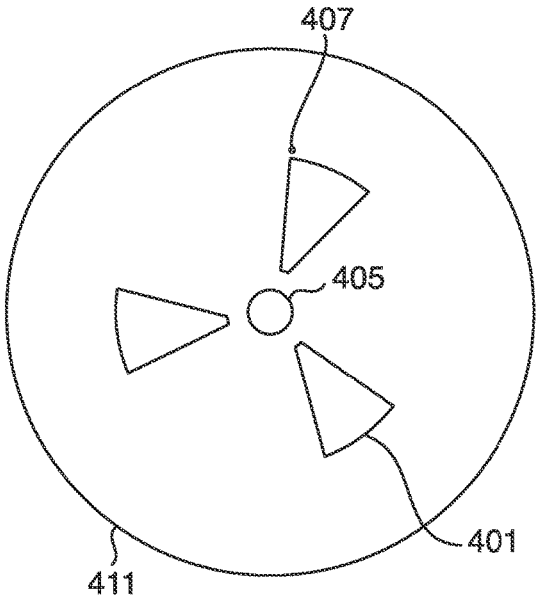
FIGS. 4A, 4B, and 4C provide a top view, side view, and perspective view, respectively, of an embodiment of a disk for a pacing valve.
Figure 4B:
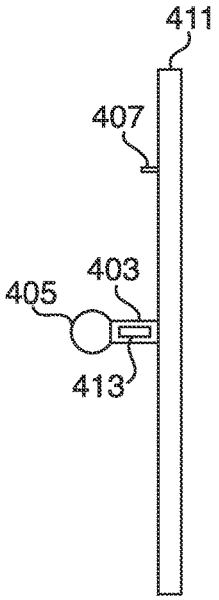
Figure 4C:
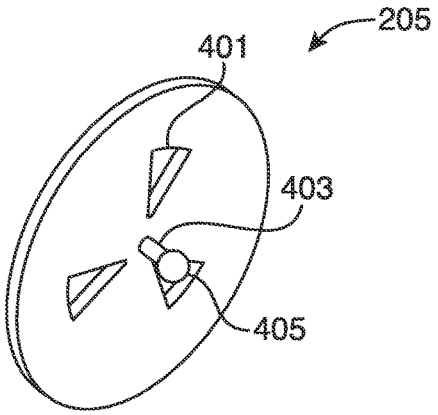

FIGS. 4A-6E provide for additional detail of the pacing valve (105) structure. The base (205), as seen in FIGS. 4A-4C comprises a generally circular platform (411) with a plurality of holes (401) therethrough. There are three holes (401) in the depicted embodiment with each hole comprising a generally triangular arc, equally spaced from the others. However, none of the number, shape, or arrangement of the holes is required. The platform (411) is in the form of a generally flat disk and is sized and shaped to cover the opening of the main body (101) of the bottle (100). The platform (411) preferably has a relatively small thickness to avoid interfering with the nipple's (107) ability to mount to the connector ring (103) or the connector ring (103) to screw onto the main body (101).

An elongated rod (403) protrudes from generally the center of one side of the platform (411) and is arranged towards the distal end (117) of the nipple (107). The distal end of the rod (403) terminates in a ball (405). This ball (405) comprises half of a ball and socket joint with the joint (605) being located on the turbine (201). This arrangement allows the turbine (201) to rotate about the axis of the rod (403). A hollow slot (413) runs through the diameter of the rod (403). The slot (413) will be used to allow for the spring (203) to be attached and rigidly held in position relative to the rod (403). To limit the rotation of the turbine (201) to a fixed arc, a second elongated rod (407) projects out of the same side of the platform (411) as the elongated rod (403). This second rod (407) is positioned nearer the edge of the platform (411) and will slide into a track (607) in the turbine (201) to limit the rotation of the turbine (201) about the rod (403) to a fixed distance.

Figure 5A:
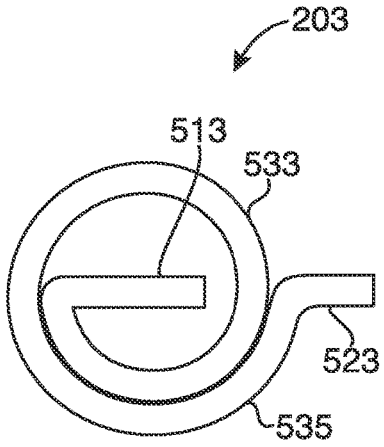
FIGS. 5A, 5B, and 5C provide a top view, side view, and perspective view, respectively, of an embodiment of a spring for a pacing valve.
Figure 5B:
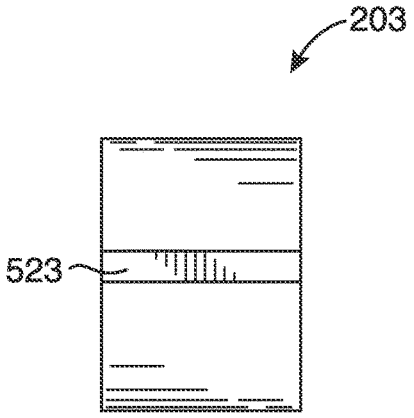
Figure 5C:
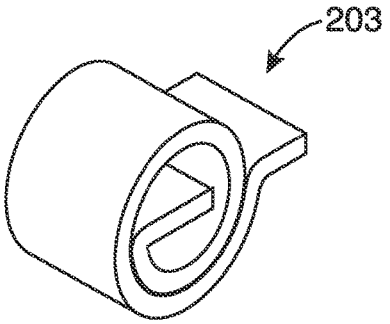

An embodiment of the spring (203) is shown in FIGS. 5A-5C, the spring (203) comprises a curled piece of plastic, metal, or another material which serves to provide a rotational return force. Specifically, it will serve to return the spring (203) to the arrangement of FIGS. 5A-5C if the legs (513) and (523) are shifted relative to each other in the plane of the page in FIG. 5A. The spring (203) joins the turbine (201) and base (205), storing energy from rotation of the turbine (201) for later use.

Figure 7:
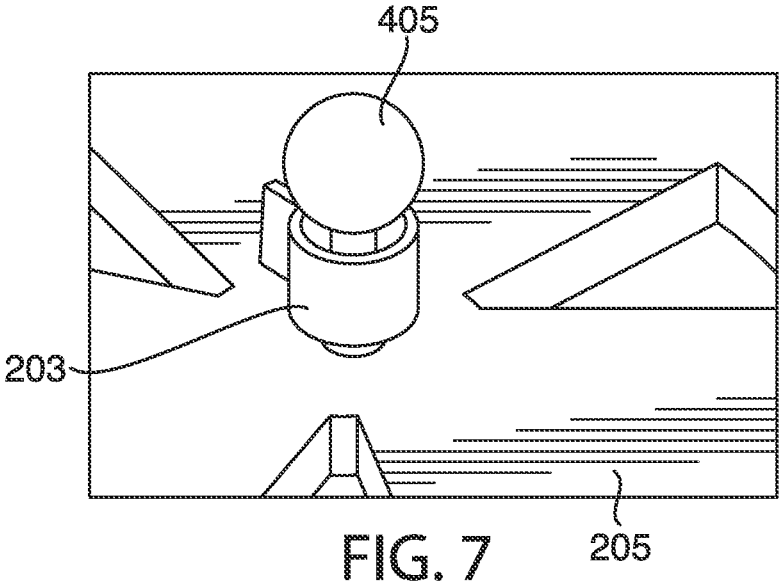
FIG. 7 depicts a perspective view of the embodiment of the spring from FIGS. 5A-5C in place on the base of FIGS. 4A-4C.

The spring (203) connects to the base (205) as is best shown in FIG. 7. The spring (203) coils around its own perimeter in larger and larger radii. Two rotations are shown in FIG. 5A, however, more or fewer can be used in different embodiments. Each end of the spring (203) forms a leg (513) and (523) to attach to the base (205) and turbine (201), respectively. The inner radius (533) of the spring (203) wraps around the rod (403) and is secured to the rod (403) by threading the leg (513) through a hollow slot (413). The outer radius (535) fits within the turbine's (201) central cylinder (635) which is the lower portion of the joint (605). The leg (523) protrudes into a slot (623) within the body (641) of the turbine (201). As the turbine (201) rotates (in either direction) it loads the spring (203).

In the preferred manner of operation, the turbine would rotate so as to move the leg (523) in the counter-clockwise direction as seen in FIG. 5A which causes the outer diameter (535) and inner diameter (533) of the spring (203) to decrease. As the spring "coils," it is loaded and the spring's biasing force will serve to return the spring to the arrangement of FIG. 5A. The spring constant, wire thickness, and dimensions are variable, as would be understood by one of ordinary skill in the art, and in an embodiment, multiple different springs of different biasing force, tension, and other properties may be provided. Specifically, different pacing valves (105) with different springs (203) may be provided. In this way, it can be constructed so that different sucking strengths are required to rotate the turbine. Thus, babies with a particularly strong suck response, who could rotate a weaker spring too quickly, can be provided with a stronger spring. In order to identify the particular strength of a particular pacing valve (105), the valves may be color coded or include indices (e.g. numbers or letters) to indicate their relative strengths.

FIGS. 6A-6E provides for an embodiment of the turbine (201). The turbine (201) of this embodiment has a body (641) of generally cylindrical shape with an outer diameter (D) slightly smaller than the inner diameter (I) of the nipple (107), and thus also smaller than the diameter (B) of the platform (411). This allows the turbine (201) to rotate freely within the nipple (107), on the platform (411), and inside the connector ring (103). The turbine (201) is placed above the platform (411) and the joint (605) fits snugly onto the ball (405) at the end of the rod (403), forming a standard ball joint.

The turbine may be generally solid with pathways therethrough or may be generally hollow. Regardless, an outer perimeter wall (643) of the turbine (201) encases the turbine blades (621) and fits within the nipple (107). The perimeter wall connects a bottom faceplate (645) and a top faceplate (647). This can be best seen in the exploded view of the parts in FIG. 3. Each of the bottom faceplate (645) and top faceplate (647) includes a hole (611A) and (611B). The holes are generally of the same size, shape and orientation to the holes (401) in the base (411) and are arranged to be offset with each other when the bottom (645) and top (647) of the faceplate are connected by the outer perimeter wall (643).

It should be noted that the ball (405) and socket (605) attachment should have minimal friction so that the turbine (201) can rotate as freely as possible about the rod (403). Further, although the ball (405) and socket (605) joints allow for larger ranges of motion than may be desired, the turbine (201) will be limited to circumferential rotation by the connection to the spring (203). This type of attachment also allows for easy assembly and disassembly, such as for cleaning.

Figure 6A:
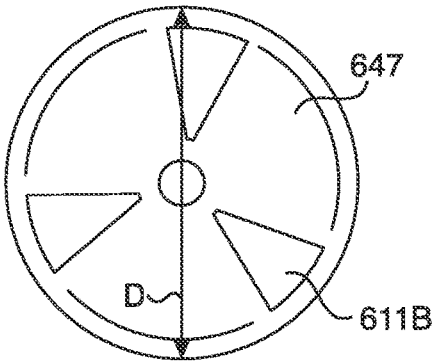
FIGS. 6A, 6B, 6C, 6D, and 6E provide a top view, side view, bottom view, side sectional view (along the line A-A in FIG. 6C), and perspective view, respectively, of an embodiment of a turbine from a pacing valve.
Figure 6B:
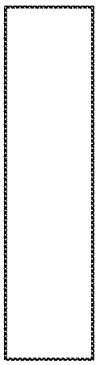
Figure 6C:
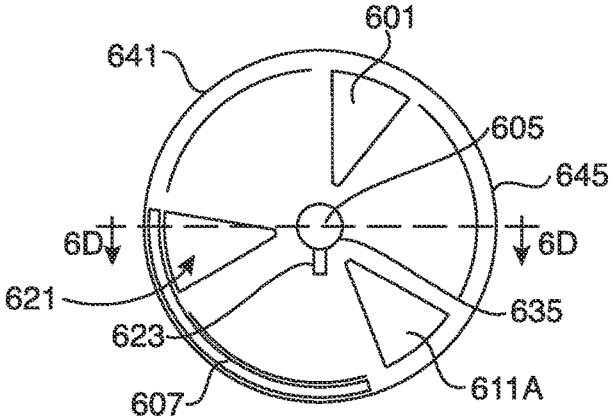
Figure 6D:
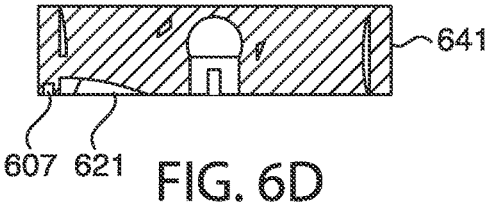
Figure 6E:
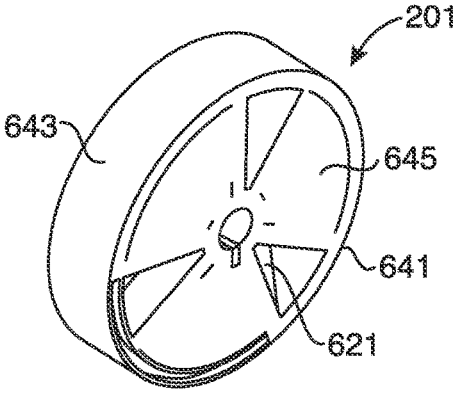

There is a track (607) which cuts through the bottom face plate (645) towards the outer perimeter (643). This track (607) houses the second rod (407) on the platform (411) and restricts the turbine (201) to about 120 degree maximum rotation. This track (607) preferably aligns with one set of open turbine blades as described below. In this way, the turbine is inhibited from movement that would allow more than one opening (601) to align with any particular opening (401). The track (607) is best seen in FIG. 6E.

The outer perimeter ring (643) secures the tip of the internal turbine blades (621). Each blade (621) is set at an angle relative to the bottom faceplate (645) and the top faceplate (647). This angle may be any angle known to one of ordinary skill but is preferably between 30 and 60 degrees relative to the bottom faceplate (645), more preferably around 45 degrees and even more preferably about 47 degrees. Each blade (621) is preferably equally spaced around the turbine and rotates about the axis at about 30°. Each blade (621) will connect one of the holes (611B) with one of the holes (611A) effectively forming an angled channel through the turbine (201), which is referred to as hole (601). In addition, there may be positioned additional turbine blades (621) insides the structure of the main body (641) to reduce the weight of the turbine (201).

In an embodiment, nine turbine blades (621) are used with six of the turbine blades (621) being internal to the main body (641) and not allowing flow into the turbine (201). Two such closed turbine blades (621) are placed between each open turbine blade (621). This is the main mechanism to restrict fluid flow through the pacing valve (105) as fluid can only flow through the channels/holes (601). Finally, there is a hollow cylinder (635) surrounding the center axis of the turbine (201) and located as a hub for the turbine blades (621). This cylinder extends from the bottom faceplate (645) towards the top faceplate (647) and terminates in a hollow spherical opening forming joint (605). This hollow cylinder (635) houses the rod (403) and spring (203) and acts as the socket for ball (405). A hollow slot (623) runs the length of the cylinder (635) to hold leg (523) of the spring (203) in place. The turbine can then rotate about its central axis with its motion resisted by the spring (203) and constrained by the second pin (407) and slot (607) arrangement.

The final assembly of the three pieces is best shown in FIGS. 2A, 3, and 7. It involves placing the spring (203) about the rod (403) and threading the inner leg (513) of the spring (203) through the elongated slot (413). The outer leg (523) of the spring would then thread into the slot (623) with the remainder of the spring (203) and rod (403) being in the cylinder (635). The ball (405) would squeeze through the cylinder (635) distending the cylinder or ball until the ball entered the joint (605). The turbine (201) would be aligned relative to the platform (411) so the second rod (407) enters the track (607). Upon attaching each component, the bottom faceplate (645) of the turbine (201) will rest in close proximity to the platform (411), although it preferably will not touch it to reduce friction. However, in an alternative embodiment, the bottom faceplate (645) and platform (411) will touch and either component may include a reduced friction surface.

The spring (203) will initially be in the relaxed position of FIG. 5A and the lower openings (611A) of the bottom faceplate (645) will be aligned with the openings (401) in the platform (411). Thus, there is a passageway from under the platform (411), through the holes (401), into the holes (611A) and through the channel (601) and then out the holes (611B). In this position, the second rod (407) will sit inside the track (607) generally at one end thereof and potentially in contact with the sides and/or end of the track (607).

Once the pacing valve (105) has been assembled, the platform (411) is placed on the rim (123) of the bottle (100) with the turbine (201) arranged above the main body (101). The nipple (107) would then be placed on top of the pacing valve (or internal to the connector ring (103)) and the connector ring (103) would be screwed onto the mating threads (113) to secure both the nipple (107) and pacing valve (105) to the main body. It should be recognized that while this arraignment is preferred as it allows the pacing valve to be removable, it is not required and in an alternative embodiment the pacing valve may be constructed to be permanently attached to the main body (101), nipple (107), and/or connector ring (103) such as, but not limited to, by being monolithically constructed with those components or through the use of adhesives or other connecting methods, such as sonic welding.

In operation, when the infant is sucking on the nipple (107) the pacing valve (105) will function in the same manner as a typical turbine known to those of ordinary skill in the art. The velocity of the fluid flow from the main body (101) to the nipple (107) from the infant's suck will drive the turbine (201) to rotate as the fluid passes through the channel (601). This rotation will produce a torque that loads the spring (203) and will also serve to slowly misalign the openings (611A) with the openings (401). The second pin (407) will also traverse the track (607).

As should be apparent, the three openings (611A) of the bottom faceplate allow significant fluid through to the nipple (107) only when at least partially aligned with the openings (401). In the initial open state, fluid flows through the turbine (201). As fluid flow drives the turbine (201) to rotate, fluid flow will be continually restricted due to the continuously increasing misalignment of the openings (611A) and (401) until the force of the sucking action is no longer sufficient to pull fluid through the constricted opening. This position is the closed state of the pacing valve (103) and there is little to no overlap between the open slots (611A) and the slots (401), hence little to no fluid (or more accurately insufficient fluid for the infant to be feeding) can move from the main body (101) to the nipple (107).

The stoppage of the fluid flow in the closed state of the pacing valve (105) cues the infant to stop sucking and swallow and breathe. As the infant ceases sucking, the load on the spring (213) will release its energy and rotate the turbine (201) back to its initial open position at which point fluid will freely flow through the pacing valve (which is now in the open position again) and the process will begin again. The secondary rod (407) and track (607) is provided to prevent the turbine (201) from turning too far if the infant has a particularly strong or persistent sucking action (e.g. they do not breathe until after the pacing valve has been in the closed position for a reasonably substantial amount of time). Such a scenario could result in the turbine (201) rotating to a point where the next turbine hole (611A) aligns with the a different hole (401). Thus, should this scenario occur, the second rod (407) will contact the far end of the track (607) from its starting point and prevent any further motion of the turbine (201). The rod (407) and track (607) can also inhibit the spring (203) from backlashing the turbine (201) past the open position when moving from the closed to open state.

It is understood that an infant may be fatigued from the difficulty to feed using the device as the infant is working against the spring (203) biasing force with every suck. It is not believed that this will cause any harm to the infant, but fatigue and frustration are not ideal as they may hinder the infant in learning proper feeding techniques. This concern is best relieved by altering the spring (203) stiffness to select a spring (203), and therefore pacing valve (105), which has the appropriate force based on the particular infant's suck strength.

It is preferred that the base (205) and turbine (201) be made out of a lightweight plastic with the same or similar properties as the type of plastic used in making baby bottles. This will provide sterility and the ability to be washed in the same manner as the baby bottle. The spring will preferably be made of a non-reactive metal for similar reasons. It is unlikely fluid will be in significant contact with the spring (203) as the spring (203) is essentially encased in the cylinder (635) and blocked by the solid part of the platform (411).

In an embodiment, the base and turbine will both be made of polypropylene or another durable and generally inert material. Polypropylene is a durable plastic commonly used in baby bottles, and thus is known to interact safely with the fluids infants feed on while providing the structural stability required. It is non-toxic, including Bisphenol A (BPA) free, and has a melting point of 160° C., making it sufficient for warming formula before a feeding if desired. It also has a high resistance to stress. Polypropylene is also lightweight, which assists the turbine (201) to rotate given the low flow velocities and pressures encountered during infant feeding. Another significant property of polypropylene which makes it conducive to construction of the base (205) and turbine (201) includes its resistance to many agents, and although there are a few agents that cause it to degrade, such as UV radiation, these agents are not factors that will be encountered by the device during typical use. This resistance allows for the parts to be used for long periods of time, to be dishwasher safe, and to resist degradation from normal use.

The spring (203) is preferably made of Type 316 stainless steel. This is highly resistant to corrosion, making it a safe material for interaction with fluid within the bottle (100) and for cleaning. Alternatively, the spring (203) can be made out of a plastic.

As many infants will eventually pick up on the rhythm of feeding after 4 or 5 repetitions during any given feeding, when an infant begins to start pacing naturally, it can be beneficial to let the infant maintain this pace on their own without the assistance of the device. This will encourage correct feeding behavior. Since initiating feeding can be difficult, it would defeat the purpose to remove the bottle from the infant's mouth to remove the pacing valve (105) if the infant begins to self-pace. In an embodiment, the pacing valve (105) will be capable of being externally shut off during the feeding without disturbing the feeding. In particular, the turbine could be locked into the open position.

In an embodiment, this locking can be provided by a switch near the connector ring (103) which can be used to engage with the turbine (201) and prevent its rotation. Generally, this would be accomplished by providing a connector ring (103) specifically designed for this purpose as the switch would generally need to act through the main body (101), connector ring (103), and/or nipple (107).

Alternatively, there can be provided a frictional or rotational engagement in the turbine (201). In an embodiment of such an arrangement, a ball bearing and slot arrangement could be provided where the bottle (100) has a particular rotation and orientation. In one orientation, the ball bearing is disengaged from the turbine (201) and the turbine (201) may rotate as discussed above. In an alternative arrangement, the bottle (100) itself may be rotated about its axis which will cause the ball bearing to move and frictionally engage the turbine (201) serving to lock it into a particular position.

In a still further embodiment, a latch can also be included to prevent the turbine (201) from spinning, thus turning the device off. The latch could simply move in front of the second rod (407) securing the rod (407) at a fixed point in the track (607) and preventing the turbine (201) from opening. The latch may attach to the platform (411) and be aligned with the track (607). In the unlocked position, the latch will be in the plane of the platform (411), not extending any significant distance into the track (607). In the locked position, the latch will be pointed upwards, going into the track (607), thus preventing the second pin (407) from moving in the track (607).

While the above has discussed a particular system for providing mechanical pacing of an infant feeding while using a pacing valve, there are also described herein additional alternative embodiments of a pacing system.

In a first embodiment, there is a provided a custom nipple which is a generally a thicker nipple design, in which small tubes connect the nipple opening to the main bottle opening. The outer edge of the nipple follows a standard nipple shape as shown in FIG. 3 with the cylindrical teat extending from a wider base. In this nipple, the inner edge of the nipple is solid silicone, filling the entire inner region of the nipple (the volume of the nipple within the baby bottle). At the end of the teat, a nipple opening allows fluid flow through the tip of the teat to the infant's mouth. The base of the nipple contains a lip which has a larger diameter than the rest of the nipple, to prevent the nipple from coming out of the collar of the baby bottle. From the base of the solid silicone nipple, begin 3-4 hollow cylindrical tubes. Each tube connects to the teat opening, allowing fluid from the bottle, through the openings in the base of the nipple and into the infant's mouth. A chemically safe, silicone material may be used, similar to standard infant nipples.

There is then provided a generally cylindrically shaped collar. The inner portion of the lower lip of the collar is designed to screw onto a standard NICU baby bottle. A switch is located on the outer portion of the collar, easily accessible by a NICU nurse to change the state to one of 2-4 finite positions. The switch is easily moved by the thumb of the hand administering the bottle. Within the collar, a thin disc is connected to the switch. The disc aligns perpendicularly with the flow of fluid and is approximately the same diameter as the base of the nipple. It lies extremely close to the base of the nipple. The disc contains an equal number of holes as the number of tubes that connect the teat to the base of the nipple. The switch is connected to the edge of this disc. When the switch is in the off position, the disc rotates to a position so that the holes in the disc do not align with the holes in the base of the nipple, and no fluid may flow through the bottle. From above, the collar has a donut shape, with an inner diameter that is wider than the nipple base diameter, but smaller than the nipple base lip. This allows the nipple to pop into the collar securely.

In this embodiment, the nipple and collar system is designed to allow a nurse to quickly and easily start and stop the flow of fluid to an infant immediately. By intermittently stopping the fluid flow, the infant will be cued to stop sucking, swallow the fluid and breathe, preventing aspiration and other complications. When the infant is ready to suck again the nurse can start the flow of fluid without the nipple leaving the infant's mouth.

To intermittently stop the flow of fluid, the user moves the switch on the outside of the collar. Internally, the switch is connected to the disc, which now rotates to the on position and aligns with the holes in the nipple. The switch can then be switched back to the off position, which rotates the disc to misalign with the holes in the nipple and stop fluid flow. In the off position, the volume of fluid in the nipple would be approximately 1 cc, enough for 1 bolus (1 swallowing iteration) for the premature infant.

In a still further embodiment, there is a floating ball design, where the ball clogs the nipple to prevent fluid flow. The nipple in this design has a standard outer shape shown as in FIG. 3. A standard thickness is used for the silicone nipple. The lip of the base of the nipple secures the nipple in place. A standard collar screws on to a baby bottle and holds the nipple securely in place. A mesh metal cylindrical cage is located in the center of the collar, aligned with the flow of fluid from the bottle to the nipple. The cage acts as a track, for an enclosed floating ball, preventing the ball from leaving the cage. The end of the cage closest to the teat is directly in contact with the inner surface of the nipple. The other end of the cage is free within collar.

On the outer edge of the collar, a switch can be set to 3 positions. The switch is designed to be easily maneuverable by the thumb of the user who is feeding the infant. The 3 positions for the switch are on, off and auto. In the On position fluid is allowed to flow through the bottle. In this state the switch manually moves the ring at the bottom of the cage away from the teat, preventing the ball from stopping fluid flow. In the Off position the switch manually moves the ring at the top of the track towards the teat, to force the ball to prevent fluid flow through the nipple. In the Auto position, neither ring is moved, which allows the ball to float. When the infant sucks, the ball moves with the flow of fluid and is sucked onto the ring near the teat. The ring stops the ball, and clogs the device, preventing flow. Once the infant stops sucking, the ball may once again float away from the ring and allow fluid to flow into the teat.

This lift and clog design incorporates a ball and track system to halt formula flow. In this system a non-reactive mesh metal divider separates the nipple from the rest of the bottle. The divider is located as far away from the nipple end as possible. The mesh allows formula to flow through the divider into the nipple opening. A plastic, air filled ball of about 1 cm diameter is trapped within the mesh nipple portion. The ball floats to the top of the liquid within the bottle (the bottom of the bottle when in the upside down drinking position). When the formula flow velocity is quick enough, the ball will be sucked into the nipple end and plug the flow of milk from reaching the infants mouth. Once the flow has stopped, the infant is cued to breathe and swallow. The formula stops flowing and the ball floats away allowing for future repetitions.

A switch would extend from the base of the nipple cap and have an On and Off position. The switch would be attached to a thin metal rod that obstructed the nipple ending in the Off position so that the ball could not clog the formula flow. Ball in cage check-valve concept. When the infant ceases to suck/breathes, the hollow ball floats to top of cage and the space below the ball fills with liquid. When the infant sucks forcefully enough, the ball will be entrained to seat on the ring and occlude flow. Flight of ball determines bolus volume. The ball in cage/lift and clog mechanism has a base that sits on the neck of the bottle and gets secured in place when the cap is screwed on. There is a cage that sits inside the bottle and attaches to the base. The cage is only (3 or 4) skinny rods in a cylindrical shape, meant to keep the ball in a guided track. The cage's outer diameter is barely smaller than the neck to allow easy insertion of the device, yet large enough to prevent any leaks. By the neck of the bottle, there is a ring of a smaller circumference than the ball. This ring stops the ball, thus clogging the device. The ring is solidly attached to the cage and base components. The ball must match the circumference of the inner cage and be larger than that of the ring. It will be understood that the buoyancy of the ball is key for the proper operation of the device.

In the event that the device gets caught or stuck, thus inhibiting the function of the device or feeding in general, the option to reset the device would further advance the design. This, however, is generally unlikely since the material flowing through the turbine is usually a smooth liquid. Infant formulas are designed to quickly dissolve in water and to not have "lumps" as this can be dangerous in feeding. Thus, the turbine is unlikely to jam (barring a failure of a portion of the device) as there is little for the device to jam on. Further, a jam resulting for damage to a component should result in the devices use being quickly discontinued anyway to prevent any danger.

Figure 8:
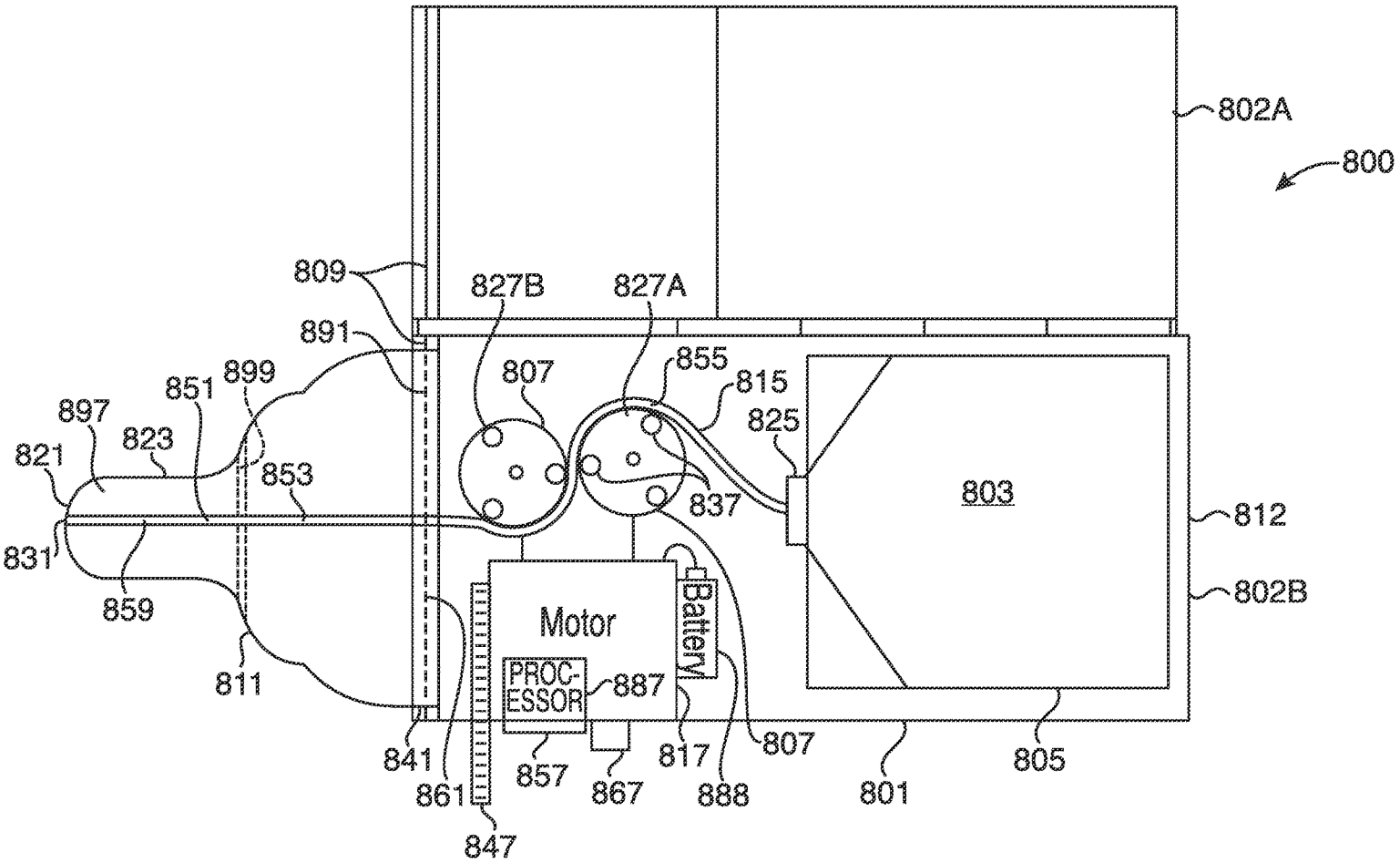
FIG. 8 depicts a view of an embodiment of a baby bottle including a peristaltic pump.

FIG. 8 provides for a still further embodiment of a feeding system. In the embodiment of FIG. 8, the bottle (800) is designed to use a peristaltic pump (807) or similar system to provide for regulated fluid flow and to provide for hard cutoff of available fluid. An advantage of the embodiment of FIG. 8 is that the pump (807) is designed to provide for a wide range of feeding quantities as well as being able to control a rate of feeding allowing the bottle (800) to accommodate the needs of a variety of infants of different weight and feeding ability.

In the bottle (800) of FIG. 8, the flow is designed to be controlled by a nurse or external operator implemented by mechanical means, instead of being controlled by the infant. In the bottle (800) of FIG. 8, milk or formula (803) is provided inside a storage chamber (805). The storage chamber (805) may be a variety of different vessels which may be generally of rigid construction, such as for example constructed of rigid plastic or metal, or may be of flexible construction in the form of a bag. In an embodiment, the storage chamber (805) actually comprises a traditional bottle body of the type currently used for feeding premature infants, but a nipple is not attached thereto. The storage chamber (805) will generally hold an amount of fluid that is intended for a single feeding. This will often mean that the storage chamber (805) is capable of holding about 1 or 2 centiliters of fluid, but any amount can be used depending on embodiment.

The chamber (805) will generally be filled with either previously expressed milk, with prepared formula, or with some combination. Other fluids (803) may also be provided in particular cases, such as to provide oral medication. The chamber (805) may be filled separately, in an embodiment, and then sealed with a cap such as a single use locking cap. Such a single use locking cap can be, but is not limited to, one which is irrevocably damaged when it is removed or used such as those traditionally used for food which have a breaking locking ring, or those that include a breakaway tab to form a connection hole. This allows for formula or other fluids to be prepared in advance and stored in a plurality of storage chambers (805).

When it is time to feed an infant, a storage chamber (805) is attached to a feeding tube (815). The tube (815) will generally be removable from the chamber (805) and attached to the chamber (801), but it may be co-formed as a part of the chamber (805) or as part of a cap for the chamber (805). The tube (815) is then threaded through the rollers (827) of a peristaltic pump (807) which is connected to an attached motor (817) and control system (887). The motor (817) is preferably a stepper motor which is capable of producing a certain fixed amount of motion based on number of complete or partial rotations. The stepper motor (817) will preferably have a step size sufficiently small that each step is no larger than the rotation between adjacent rollers (827) of the peristaltic pump (817).

Once threaded through the pump (807), the tube (815) continues into the nipple (811) from within the body (801) of the bottle (800). In the depicted embodiment, the tube (815) is positioned so as to be in contact with the end (821) of the nipple (811) and will generally be positioned so as to place its hollow internal volume (851) in contact with a hole (831) located at the end (821) of the nipple as is common in nipples today. This segregates the hollow internal volume (851) of the tube (815) into two segments. A forward segment (853) into which segment the peristaltic pump (807) will feed fluid, and the rearward segment (855) which is in fluid communication with the storage chamber (805). It also allows the drip rate of the bottle (800) to be selected by the size of the hole (831) as is currently known to those of ordinary skill in the art.

Depending on the embodiment, the tube (815) may be co-formed with the nipple (811) so as to provide for the positioning discussed above, or it may be manufactured separately. In an embodiment, the nipple (811) may include a positioning guide or mount that allows for the tube (815) to be reliably positioned. For example, the forward end of the tube (815) may act as a male connector with a molded mating female connector being positioned on the inside of the tip (821).

Alternatively, the tube (815) may simply be positioned in the depicted arrangement because that is the most likely position given the shape of the nipple (811) tip (821) and tube (815). This arrangement can work particularly well if the outer diameter of the tube (815) is generally similar to the inner diameter of the teat (823) portion of the nipple (811). In a still further alternative embodiment, the tube (815) does not need to be positioned directly adjacent to the hole (831), but there may be positioned within the nipple (811) a sub-chamber (897) which is formed by a barrier (899) (shown in dashed form as this element is need not be present in FIG. 8 as depicted, but could be positioned in a location such as this), which can even comprise the entire internal volume of the nipple (811)) which is in contact with the hole (831) and to which the tube (815) is in fluid communication.

Regardless of how the tube (815) is connected to the hole (831), their will generally be considered a fluid reservoir created by the arrangement. Specifically, the reservoir is the fluid which is within the forward portion (853) of the internal volume (851) of the tube (815) and any sub-chamber (897) to which that forward volume (853) is attached prior the hole (831). For ease of reference, and regardless of embodiment or volume, this volume is referred to as the feeding reservoir (859) herein. In the depicted embodiment of FIG. 8, the feeding reservoir (859) has essentially the same volume as the forward portion (853) because there is no sub-chamber (897) depicted. However, if the barrier (899) was present and the tube (815) was retracted slightly so as to create a gap between the end of the tube (815) and the end (821) of the nipple (811) allowing fluid flow between them, the feeding reservoir (859) would comprise the combined volume of the forward portion (853) and the sub-chamber (897).

Regardless of the manner of positioning of the tube (815) to form the feeding reservoir (859), the tube (815) will generally extend from the chamber (805) through the pump (807) and into the teat (823). This is, however, not required as the tube (815) may terminate at a point outside the teat (823) if a barrier (899) is present outside the teat (823). Generally the tube (815) will be constructed of medical silicone or a similar material and in an embodiment, the material used is similar to the material of which the nipple (811) is formed. In order to position the tube (815), the tube (815) will generally be placed first inside the nipple (811) through its open back end (861) and then simply pushed up into contact with the tip (821). Alternatively, the tube (815) can be threaded through the tip (821). In this later embodiment, the hole (831) will generally simply be the end of the hollow interior (851) of the tube (815) as opposed to their being a separate hole (831). The tube (815) will be considered "thick walled" in many embodiments and may have a wall thickness greater than or equal to the diameter of the internal volume (851).

Once the tube (815) and the nipple (811) have been connected, the tube (815) will generally be connected to the chamber (805). The entire tube (815), chamber (805), nipple (811) assembly will then be laid into the body (801) of the bottle (800). With the tube (815) run through the peristaltic pump (807) resulting in the tube (815) being pinched by the pump wheels (827) in the well understood manner of a peristaltic pump (807). In order to facilitate the assembly positioning, the body (801) may open as a clamshell with a lid (802A) being hinged to an opposing clamshell base (802B) to form the body (801). Similarly, the pump wheels (827A) and (827B) may be moved apart (e.g. with wheel (827B) moving left and wheel (827A) moving right in FIG. 8) potentially through mechanical interconnection with the clamshell halves (802). The bottle (800) body (801) may also include an internal channel (809), the walls of which are designed to be positioned on either side of the mounting ring (891) which is commonly used to retain nipple (811) into the screw ring of a traditional bottle. This will serve to position the nipple (811) in the body (801). Alternatively, the nipple (811) may be attached to the body (801) using a screw ring of standard design used in baby bottles known to those of ordinary skill in the art.

It should be recognized that FIG. 8 provides only a single embodiment of a bottle (800 and the arrangement and assembly of components. In an alternative embodiment, the chamber (805) may be part of the body (801) and is filled with milk or formula in place. This design, however, is generally less preferred as it can be difficult to clean the chamber (805) and the depicted embodiment of FIG. 8 allows for the chamber (805) to be a single use disposable component. In a still further embodiment, the tube (815) may be positioned first (or may be formed or provided as a part of the bottle (800) and the chamber (805) may be in the form of a cartridge which slides into the rear (812) of the bottle (800). Depending on arrangement, the connector (825) may comprise a snap connector with two mating halves which can securely lock together. Alternatively, the tube (815) may terminate at a needle and the chamber (805) may be in the form of a medication bottle designed for use with a syringe which has a rubber sealing surface designed to be penetrated by a needle to create a fluid pathway. Depending on embodiment, other forms of connection which allow for the chamber (805) to feed fluid in to the feeding reservoir (859) are also possible. The only requirement is that the storage chamber (805) be able to feed the feeding reservoir (859) in definable metered units.

Generally, the chamber (805), tube (815), and nipple (811) assembly will be designed to be disposable after a single use. As should be apparent, the use of a peristaltic pump (807) to move the fluid provides that the chamber (805), tube (815) and nipple (811) are the only components in fluid contact with the milk or formula and the infant's mouth. The remaining components of the device (800) can therefore be reusable between multiple infant's and multiple feedings, potentially with minimal cleaning and/or sterilization. While this arrangement is preferred, it is not required and the whole device (800) may be disposable in an alternative embodiment, or may be entirely cleaned and sanitized between uses.

As indicated above, the motor (817) is generally a stepper motor and is designed to provide for the ability to produce particular step-wise motion even in partial or complete revolutions of its drive shaft. The wheels (827) of the peristaltic pump (807) will generally be sized and shaped so that they will rotate between two adjacent contact wheels (837) being at a fixed location with the tube (815) for a given number of steps producible by the motor. Gearing to accomplish this may be provided as necessary. Thus, the motor (817) can produce a single step between two adjacent rollers or the distance (837). This means that a relatively small amount of fluid in the tube (815) (specifically the amount of material that fits in the tube (815) between the two adjacent rollers (837)) will be pushed from the hollow interior (851) of the tube (815) that is behind the pump to that space (853) in front of the pump (807). This corresponds to an increment of fluid that is moved from the storage chamber (805), to the feeding reservoir (859) in a single iteration of the pump (807). Thus, the amount of fluid available in the feeding reservoir (859) is equal to the amount of fluid moved by the pump from the storage chamber (805) to the feeding reservoir (859) since the device (800) started operating minus the amount of fluid removed from the feeding reservoir via the hole (831).

It should be apparent from the above, the maximum amount of fluid that can be obtained by an infant sucking on the teat (723) at any time is the amount of fluid in the feeding reservoir (859) at that time. Thus, to control the feeding, a user will generally select the amount of fluid they want to provide the infant between each swallow and breath (the amount per suck) or at predetermined periods of time using a control dial (847) or similar device. This serves to regulate the amount of fluid in the feeding reservoir (859), generally by providing a maximum amount available. The amount to be provided as set by the control dial (847) will generally be interpreted by a control system (887) (such as but not limited to an appropriately programmed microprocessor) which then serves to operate the stepper motor (817) to provide the desired amount based on a certain number of pump (807) rotations being initiated. The amount provided may be shown on a display (857) which can also provide other valuable feeding information including, but not limited to, the total amount of fluid provided or the amount of time the feeding has progressed for.

In operation the device of FIG. 8 will generally work as follows. A user (such as, but not limited to, a nurse or parent) will generally prepare a chamber (205) with milk, formula, some combination thereof, or another fluid they are intending the baby to consume orally. They will then load the chamber (805) into the bottle (800) attaching the tube and nipple as appropriate for the selected embodiment of bottle (800). Once loaded, the body (801) if necessary is closed up and the bottle (800) is ready to use. The user will now adjust the dial (847) to select the amount of fluid which is to be provided to the infant. The amount may be selected as an absolute amount per "suck" (e.g. 1 ml) or may be provided in the form of a rate (e.g. 1 ml per minute).

Once the feeding amount has been selected, the bottle (800) will generally be turned upright (placing the left side of device (800) as illustrated in FIG. 8 below the right side to insure fluid (803) is accessible to the tube (815)) and turned on (such as by switch (867)). The bottle (800) is then provided to the infant. The control system (887) will generally prime the bottle (800) by providing at least a certain amount of fluid (803) from the storage chamber (805) to the feeding reservoir (859) upon the bottle (800) being activated to provide for fluid at the hole (831) and to encourage feeding.

The motor (817) will now turn based on the desired feeding amount. The activation of the motor (817) will generally be controlled by the control system (887) which may be a computer processor of standard type and appropriate software (instructions stored on a computer readable media) to provide the amount, or by corresponding mechanical means and structures. In the event that a fixed amount per feeding is provided, the control system (887) will generally instruct the motor (817) to turn an appropriate number of turns (generally in rapid succession) to allow that amount of fluid (803) to pass from the storage chamber (805) to the feeding reservoir (859). The control system (887) will then generally halt the pump (807) and wait for an indication of a breathing event.

The infant will now generally be sucking on the nipple (811). As should be apparent, the selected amount of fluid in the fluid reservoir (859) is accessible from the nipple (811). The fluid, however, will not generally drip out of the nipple (811) (although it may depending on the size of opening (831)). Instead, the infant will suckle the nipple (811) compressing and sucking. The compression and sucking may serve to overcome surface tension of the fluid inside the forward portion (853) of the tube (815) and expel the fluid forward and out of the hole (831) and into the infant's mouth. As should be apparent, once all the fluid in the fluid reservoir (859) has been expelled, the infant's attempts to get more fluid will not result in any more available. Instead, they will be sucking on what is essentially a pacifier. It is expected that the failure to obtain more fluid will trigger a swallow-breathe response from the infant to swallow that milk which is now in their mouth if they have not breathed before then.

Figure 11:
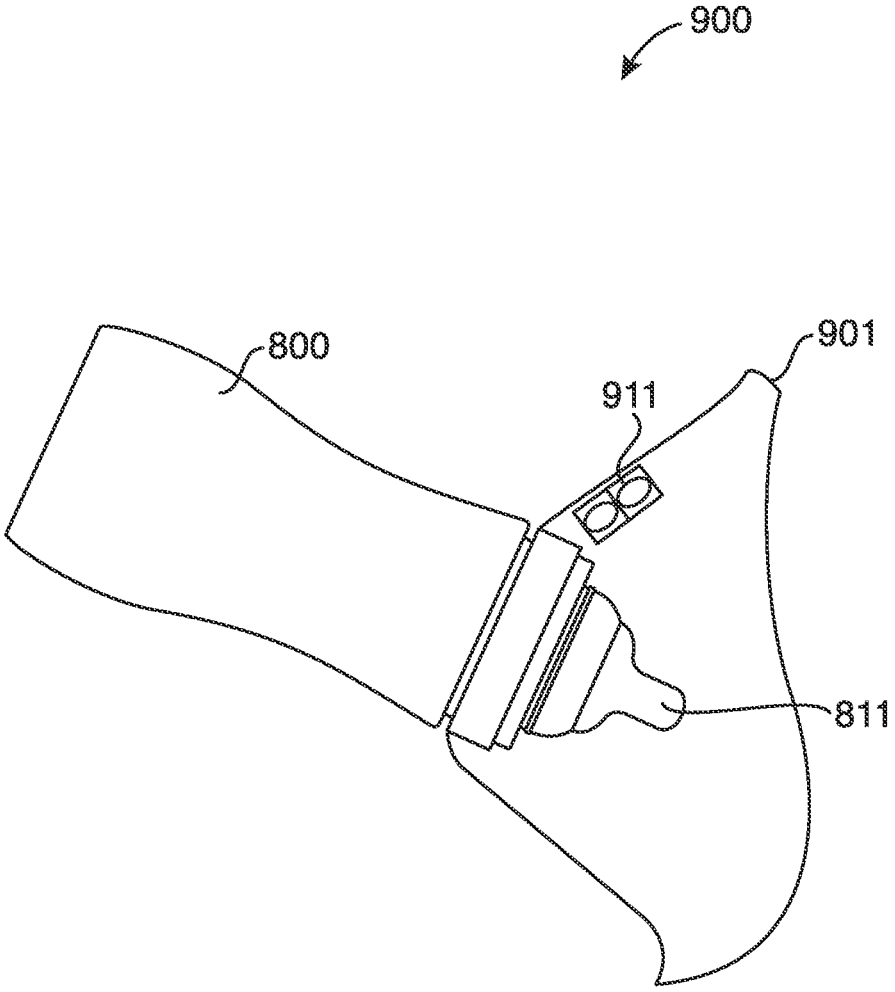
FIG. 11 depicts a view of an embodiment of a face mask including a breath sensor.

Upon a swallow-breathe response being detected from the infant (either manually by the user such as by triggering button (867) or through an automated detector such as that shown in FIG. 11), the control system (887) will again instruct the motor (817) to control the pump (807) to feed another selected amount of fluid into the fluid reservoir (859). The pattern can then be repeated until the infant either loses interest in feeding, or all the fluid in the storage chamber (805) has been expelled. As should be apparent from the above, the nipple (811) need not be removed from the infant's mouth until feeding is completed.

Upon completion of the feeding routine, the bottle (800) will be removed from the infant's mouth. The body (801) is then generally opened and the nipple (811), tube (815) and chamber (805) assembly is removed. The chamber (805) may include graduated markings to indicate the amount of fluid remaining for record purposes and/or the display (857) may be consulted to determine how much fluid the infant consumed. The nipple (811), tube (815), and chamber (805) assembly is then generally discarded as appropriate waste. The control system (887) may store information related to the feeding in an on-board memory, or such information may be discarded after feeding is complete. Alternatively, the on-board memory may be downloaded into an associated computer program such as through the use of a base station which serves to both download information from the control system (887) and may serve to recharge a battery (888) for controlling the onboard electronics and motor (817).

The operation of the bottle (800) is similar if a feeding rate is used, but the control and presentation is somewhat different. If a rate is used, the bottle (800) will generally preload the feeding reservoir (859) and wait for the infant to suck. The motor (817) will then generally perform turns to provide for the appropriate rate as the infant is suckling. For example, if the rate is 1 ml per minute and each turn moves 0.1 ml through the pump (807), the motor (817) will generally commence one turn of the pump (807) every six seconds. Alternatively, it may turn 10 times at every sixty seconds, 5 times at every thirty seconds, or any other type of pattern. As opposed to the operation with a fixed amount, there is generally no need to trigger the next pump (807) rotation based on a breath event. Instead, the pump (807) rotations occur on a generally constant timed basis. However, as should be apparent, the amount of fluid available to the infant is still limited. Thus, an infant who takes in fluid faster than the selected rate, will end up with at least a short window with no food available which should trigger a swallow-breath response. Alternatively, an infant that is feeding too slow will generally not have much available fluid to potentially choke on as the amount available is always limited by the amount in feeding reservoir (859), and this can be limited to an absolute maximum (akin to the limitation when a fixed amount is presented discussed previously). Should the feeding reservoir (859) be full, the pump (807) and/or control system (887) or attached sensor may detect this and halt the pump (807) until the amount is reduced a certain amount, or until a swallow-breath event is detected.

The above discussion of FIG. 8 provides for an embodiment of a self-contained generally handheld bottle (800) that utilizes a pre-selected food presentation and a feeding reservoir (859) of limited size compared to the available fluid (803) in the storage chamber (805). In the embodiment of FIG. 8, the pump (807) and control mechanisms (887), as well as the fluid chamber (805) are designed to generally be located inside a body (801) which generally resembles a traditional baby bottle. This type of arrangement is generally preferred as it can be a comforting design (particularly to a parent) and can provide for convenient and familiar way to feed the infant. It can also be easily handheld. However, it is by no means required and in other embodiments, the structures can be arranged differently.

Figure 9:
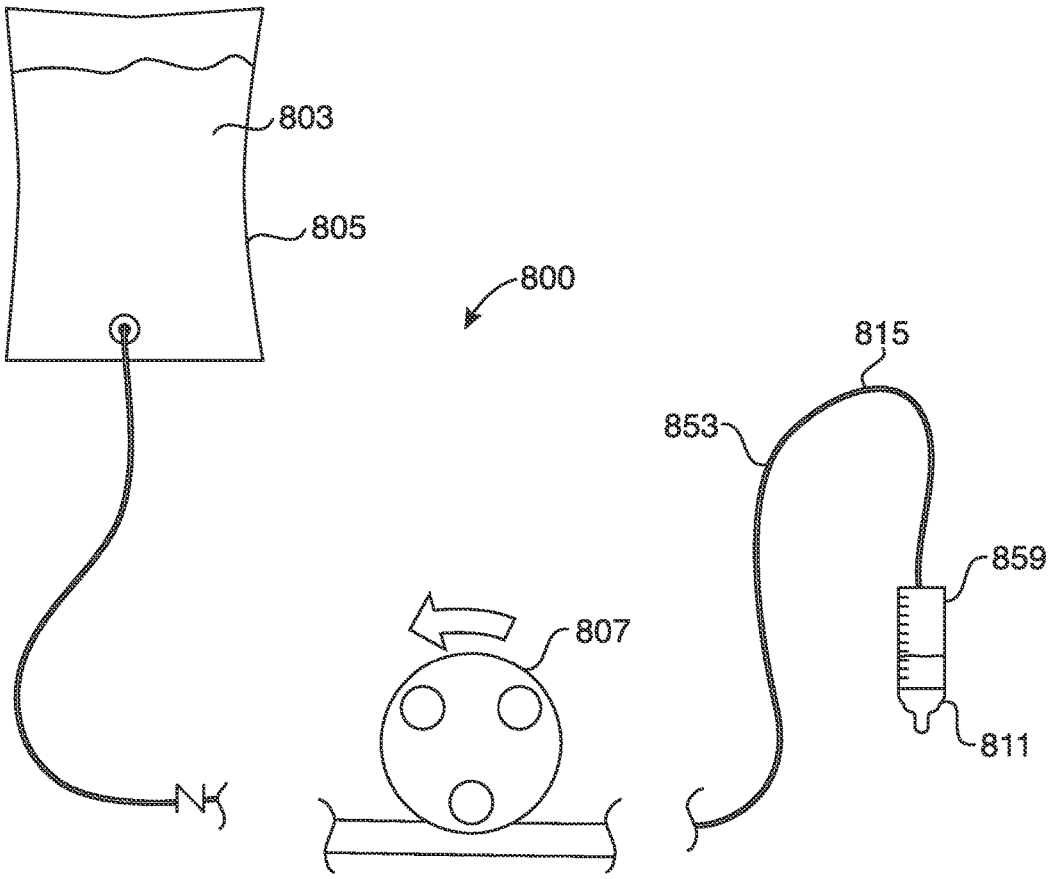
FIG. 9 depicts a view of an embodiment where the storage chamber comprises a remote hanging bag.

The embodiment of FIG. 9 for example provides that the fluid (803) is placed in a storage chamber (805) in the form of a traditional IV bag. The pump (807) and motor (817) assembly may then be external and feed a feeding reservoir (859) mounted behind the nipple (811) and at the infant. Generally, this feeding reservoir (859) will be separated from the hollow interior (851) of the tube (815) so that the entire forward volume (853) of the tube (815) is not part of the feeding reservoir (859), but this is not required. This arrangement can allow for the portion of the device (800) being held by the user to be substantially smaller and may be particularly useful for extremely small infants where the device of FIG. 8 could be larger than the infant.

A concern with the device of FIG. 9 is that the amount of fluid available to the infant will generally be much larger than in the device of FIG. 8 if the tube (815) forward (853) of the pump is part of the feeding reservoir (859). For this reason, there will generally be provided a feeding reservoir (859) at the nipple (811) (which may be at least a portion of internal volume of the nipple (811) itself) and some form of cut-off valve positioned to segregate the hollow interior (851) of the tube (815) from the feeding reservoir (859). This could, for example, be a valve of known type.

Figure 10:
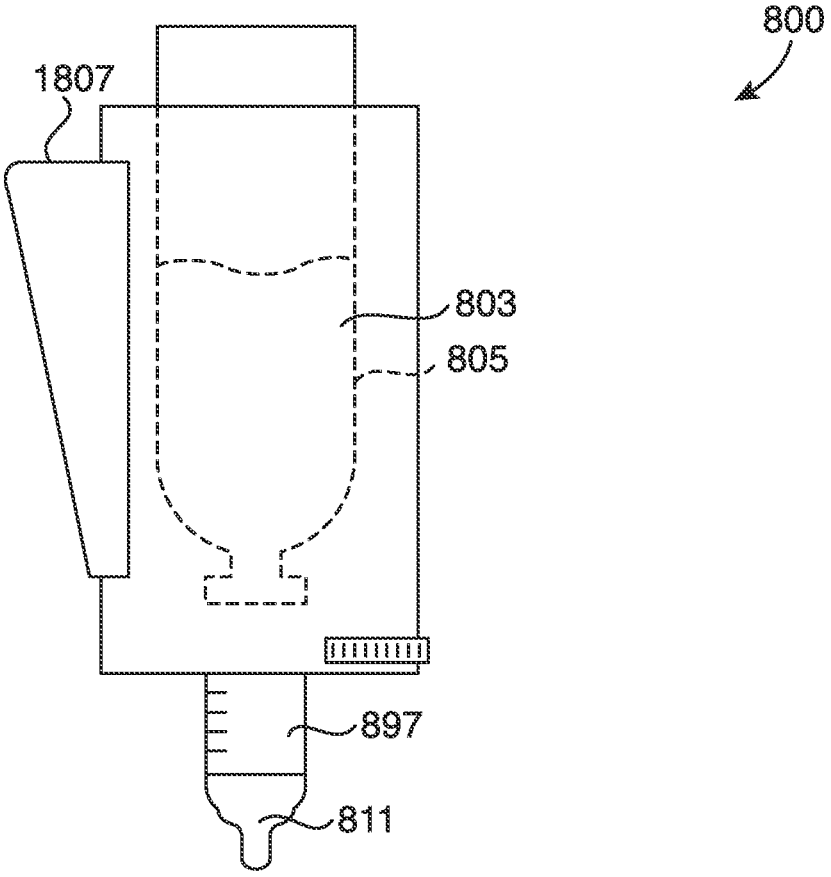
FIG. 10 depicts a view of an embodiment of a baby bottle including a hand pump.

FIG. 10 provides for a still further embodiment of a bottle (800). In this embodiment, instead of having a peristaltic pump (807) control the transfer of fluid from the chamber (805) into the feeding reservoir (859), a mechanical hand pump (1807) is used. The user in this case simply presses the hand pump (1807) which can operate any form of connection to move an amount of fluid from the storage chamber (805) to the feeding reservoir (859). The hand pump (1807) can then return to its ready position and close of the chamber inhibiting further fluid flow.

In an embodiment of FIG. 10, the motion of fluid (803) can still be performed using peristaltic motion and interacting wheels just using a hand pump (1807) instead of the motor (817). Alternatively, the hand pump (1807) (or a related device) can drive a plunger which serves to slightly pressurize the chamber (805). To relieve the pressure differential, the chamber (805) can then push fluid into the tube (815) until pressure is equalized such as through a standard pressure valve. Obviously, the plunger structure can alternatively be mechanized using a stepper motor (817) or other mechanical means to drive the plunger forward releasing fluid (803) at predetermined times to the feeding reservoir (859) which is a variation on the design of FIG. 8.

An embodiment utilizing pressure differential to feed the tube (815) from the storage chamber (805) can be particularly useful for certain infants. A plunger arrangement can be very familiar to current nurses as it is similar to feeding with a syringe and tube which is commonly performed in hospital settings. This embodiment of bottle (800) can, therefore, allow for the use of a syringe and tubing typically used in tube feedings to be provided with a device (800) to adapt the system directly into a bottle system (800) for intermittent flow oral feedings. To provide a hard cut-off, the flow can be regulated by an on-off switch (manual or automatic) which can inhibit the fluid (803) from flowing even in the event of a pressure differential from an infant continuing to suck. This can allow for the plunger to be provided with a constant pressure (e.g. from a mass or from a user maintaining a constant force on the plunger) while still dispensing fluid intermittently.

FIG. 11 provides for an embodiment of an automated breath sensor (900) for use with a system (800). In FIG. 11, components of the bottle (800) are supported in a full or partial face mask (901) in a manner to support the components as necessary and allow the nipple (811) to be available to an infant. A full mask may be preferred if the infant requires a feed of oxygen while breathing or a similar situation, while a partial mask would generally be preferred for an infant that can breathe air on their own as not to restrict air flow about their face. The mask (901) is designed to fit over the nipple (811) or other component of the bottle (800) so as to place a breath monitor (911) in the proximity of the infant's nose. It is well established that infants breathe primarily through their nose (often only breathing through their mouth while crying) and generally don't breathe through their mouth while feeding.

The breath monitor (911) may be any type of sensor capable of detecting a breath. This can be a pressure monitor detecting a change in air pressure due to a breath, or a device which senses air movement, for example. The breath monitor (911) will then generally be connected to the control system (887) for the bottle (800). This may occur through an electrical and data connection being made when the mask (900) is placed on the bottle (800). In this way, the provision of additional fluid (803) from the storage chamber (805) to the feeding reservoir (859) can be provided as part of a feedback loop. In particular, once the user has set the amount of fluid, the system will provide it and then trigger additional fluid (as discussed above) when the monitor (911) detects a breath. In this way, the feeding is accomplished automatically without need for the user to monitor the infant for swallowing and breathing at all. The entire feeding process is performed and monitored by the bottle (800) mask (900) combination.

Further, while the embodiment of FIG. 11 contemplates a breath sensor (911) it should be recognized that in an alternative embodiment, and alternative sensor may be used to detect the suck-swallow-breathe activity. For example, the sensor could detect throat movement indicative of swallowing as opposed to detecting breathing. Similarly, breathing could be detected through the use of something other than a face mask (900). For example, a breathing monitor could be provided which detects rise and fall of the lungs to indicate a breath to which the bottle (800) is connected. Still further, the control system (887) need not trigger with every breath detected, but may trigger only after a fixed number of breaths are detected.

In a still further embodiment, the breath sensor (911) could be replaced with a pressure sensor where instead of a breath event being detected at the infant the infant letting up sucking pressure on the nipple (811) is detected. This is similar to the embodiment of FIG. 1, however instead of the release of pressure directly allowing fluid to flow, there is generally still a separate step of activating the pumping of fluid from the storage chamber (805) to the feeding reservoir (859) to improve the odds that fluid beyond the desired maximum amount does not enter the feeding reservoir (859).

It should be apparent from the above that systems and methods are provided which allow for the feeding of infants that have not mastered the suck-swallow-breathe process generally considered to be standard for infant feeding. It is important to recognize that while the systems and methods discussed can serve to train an infant to perform the process through positive feedback when the process is performed correctly, the primary purpose of most of the embodiments is not training, but is to provide nutrition. In this way, the systems and methods serve to reduce or eliminate the need for an infant to remain hospitalized simply because they have not mastered the suck-swallow-breathe process or because their feeding needs to be monitored. Instead, the infant can be sent home and a parent, even with little to no training, can successfully perform and monitor feeding.

Further, while the systems and methods discussed herein are particularly useful for premature infants that have not mastered the suck-swallow-breathe process, their use is by no means confined to them. Embodiments of the systems and methods can also be useful for infants, including full term infants, that have other medical issues that can complicate feeding or for infants where monitoring the amount of food intake is important. As the systems and methods are capable of monitoring and recording details of each feeding in a variety of ways, the systems and methods can be useful for feeding any kind of infant where monitoring of fluid uptake, rate of fluid uptake, and other feeding criteria are desired. An example of alternate applications would be for infants with gastroesophageal reflux, for whom slow, graded feedings can eliminate symptoms of reflux by providing time for gastric emptying prior to more fluid flowing from the nipple for the infant to then manage. It can also be used with infants who tend to consume bottles too quickly, increasing symptoms of discomfort and gas, by slowing down the feeding and allowing fluid to only flow at predetermined, specific intervals of time.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A baby bottle for providing paced feeding, the bottle comprising: a storage chamber, containing a first amount of fluid;

a feeding reservoir, containing a second amount of said fluid smaller than said first amount, said feeding reservoir in fluid communication with said storage chamber; a nipple in fluid communication with said feeding reservoir; and a pump for moving fluid from storage chamber to said feeding reservoir; wherein said storage chamber, said feeding reservoir, and said pump are housed in a single structure comprising a body attached to said nipple; and wherein when an infant sucks on said nipple, they can only obtain said second amount of said fluid until they cease sucking at which point said pump will feed said second amount of fluid from said storage chamber to said feeding reservoir;

wherein when said infant ceases sucking, said infant breathes and said infant's breath is detected by an electronic sensor; and wherein said electronic sensor instructs a computer to activate said pump upon said breath being detected.

2. The bottle of claim 1, wherein when said infant ceases sucking, a change in pressure is detected by an electronic sensor.

3. The bottle of claim 2, wherein said electronic sensor instructs a computer to activate said pump upon said change being detected.

4. The bottle of claim 1, wherein said pump is a peristaltic pump.

5. The bottle of claim 1, wherein said feeding reservoir and said storage chamber are connected by a tube.

6. The bottle of claim 1, wherein said feeding reservoir, storage chamber, and tube are removable from said bottle as a unit.

7. The bottle of claim 1, wherein said storage chamber is a rigid bottle.

8. The bottle of claim 1, wherein said storage chamber is a flexible bag.

9. The bottle of claim 1, wherein said body opens in the form of a clamshell.

10. The bottle of claim 1, wherein said feeding reservoir comprises a portion of an interior volume of a tube connected to said storage chamber.

11. The bottle of claim 10, wherein said feeding reservoir consists of a portion of an interior volume of a tube connected to said storage chamber.

* * * * *